US005133581A

United States Patent [19]

Coleman

[11] Patent Number: 5,133,581

[45] Date of Patent: Jul. 28, 1992

[54] ELECTROMAGNETIC LOCK ASSEMBLY

[75] Inventor: Michael D. Coleman, Zionsville, Ind.

[73] Assignee: Von Duprin, Inc., Indianapolis, Ind.

[21] Appl. No.: 749,972

[22] Filed: Aug. 26, 1991

[51] Int. Cl.[5] ..... E05C 17/56

[52] U.S. Cl. ..... 292/251.5; 292/337; 292/DIG. 53

[58] Field of Search ..... 292/251.5, 337, DIG. 53

[56] References Cited

U.S. PATENT DOCUMENTS

| | | | |
|---|---|---|---|
| 2,278,850 | 4/1942 | Hammond | 292/163 X |
| 2,983,538 | 5/1961 | Fletcher | 292/251.5 |
| 3,431,002 | 3/1969 | Melgaard | 292/251.5 |
| 4,487,439 | 12/1984 | McFadden | 292/251.5 |
| 4,652,028 | 3/1987 | Logan et al. | 292/251.5 |
| 4,703,962 | 11/1987 | Kelly et al. | 292/251.5 |
| 4,763,937 | 8/1988 | Sittnick, Jr. et al. | 292/251.5 |
| 4,826,223 | 5/1989 | Geringer et al. | 292/251.5 |
| 5,016,929 | 5/1991 | Frolov | 292/251.5 |

*Primary Examiner*—Richard E. Moore
*Attorney, Agent, or Firm*—Robert F. Palermo

[57] ABSTRACT

An electromagnetic lock assembly has longitudinally extending interlocking protrusions and recesses in the magnet and magnet housing surfaces. This permits longitudinal movement of the magnet within the housing, but prevents lifting of the magnet out of the housing. End caps and an electronic circuitry cover clamp the magnet longitudinally within the housing and provide the mounting bolt brackets. An armature, providing for distribution of separating forces, reduces bending tendencies in the armature contact plate and thereby increases the effective separation load bearing capability of the lock assembly.

5 Claims, 2 Drawing Sheets

ELECTROMAGNETIC LOCK ASSEMBLY

BACKGROUND OF THE INVENTION

This invention relates generally to electromagnetic locks and more particularly to electromagnetic locks of the direct pull type used, for example, to lock a door against a door frame.

In large buildings, it is often desired to maintain certain doors in a locked condition and to control the locking and unlocking thereof from a remote centralized location for security reasons. In some cases, health and safety considerations require that certain doors be unlocked in order to provide ingress and egress during emergency occurrences. For such applications, electromagnetic door locks are particularly well suited. Since they generally require no moving parts, they are not subject to jamming or other mechanical malfunctions which would prevent unlocking them when desired. Locking and unlocking are, thus, easily accomplished using an electrical switch which may be located at a large distance from the door, and which may be manually operated or automatically operated in response to a feedback signal from fire alarm, burglar alarm, or other emergency protective systems.

A direct pull electromagnetic door lock commonly consists of an electromagnet located within a housing which is commonly mounted to a door frame or other stationary structure. An armature, made of a magnetizable material, is mounted to the door, or movable structure, and provides the mechanism by which the electromagnet can grip the door.

One well known method of making the electromagnetic lock housing assembly is to form an elongated rectangular canister having one open longitudinal face. The pieces used to form the canister are welded or otherwise fastened together at all corners. The magnetic lamination stack and coil assembly, the control circuitry, and required bushings are placed within the canister and connections, as appropriate, are made. A potting compound, usually epoxy or other thermosetting resin, is poured into the canister and envelops the components previously inserted This immobilizes all parts with respect to each other and essentially "glues" the parts within the canister. After finishing and testing, the housing assembly is ready for use. Another method for making this assembly is to preform a rectangular parallelepiped of thermosetting resin or other suitable insulating material incorporating the magnetic lamination stack and magnetizing coil wires, placing it within an elongated rectangular parallelepiped canister having one open longitudinal face, and securing it within the canister by means of attachment screws inserted through the canister walls. In this case, the canister itself is held together by fastening screws and is longer than the electromagnetic assembly, thereby providing space within the canister for control circuitry over which a protective cover is fastened.

Both of these methods produce functionally adequate electromagnet housing assemblies. However, in the first case, the unitized structure produced by potting the lamination stack, magnetizing wire coils, and control circuitry within the canister requires scrapping the whole unit in case of even the most minimal defect. In the second case, the screw-fastened assembly of the canister and the retention of the electromagnet subassembly within the canister by threaded fasteners seriously increases the risk of failure of the assembly in service. Very slight loosening of the threaded fasteners in shipping, handling, installation, and service lead to improperly balanced stresses and increase the likelihood of service failures of the electromagnetic housing assembly. Thus, in both cases, assembly of the canister with smooth interior surfaces requires reliance on the gluing effect of the potting compound or the continued uniform fastener tensioning for the mechanical integrity of the electromagnet housing assembly in service.

The armature, an elongated plate of magnetizable material, is fastened to one of the structural members to be locked and coacts with the electromagnet housing assembly to provide the locking function. It is commonly secured to its structural member by a single fastener located at its center. When force is exerted against the locked couple, the armature plate experiences a bending tendency due to concentration of that force at the single central attachment point. Deflection of the plate in response to that force creates a minute gap between the magnet and the plate at the concentration point which drastically reduces the magnetic holding force and which results in substandard lock function.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an electromagnetic lock assembly including a housing made-up of an elongate channel-shaped member having one or more longitudinal protrusions and/or recesses; an electromagnet contained within the housing and having longitudinal recesses and/or protrusions which intermesh with those of the housing to prevent all but longitudinal movement by the electromagnet; provision for mounting the housing on a first structural member; an armature for coacting with the electromagnet to secure contact with the first structural member; and a mechanism for selectively magnetizing and demagnetizing the electromagnet to, thereby, secure and release the armature with respect to the electromagnet.

The foregoing and other aspects will become apparent from the following detailed description of the invention when considered in conjunction with the accompanying drawing figures.

DETAILED DESCRIPTION

Figure 1:
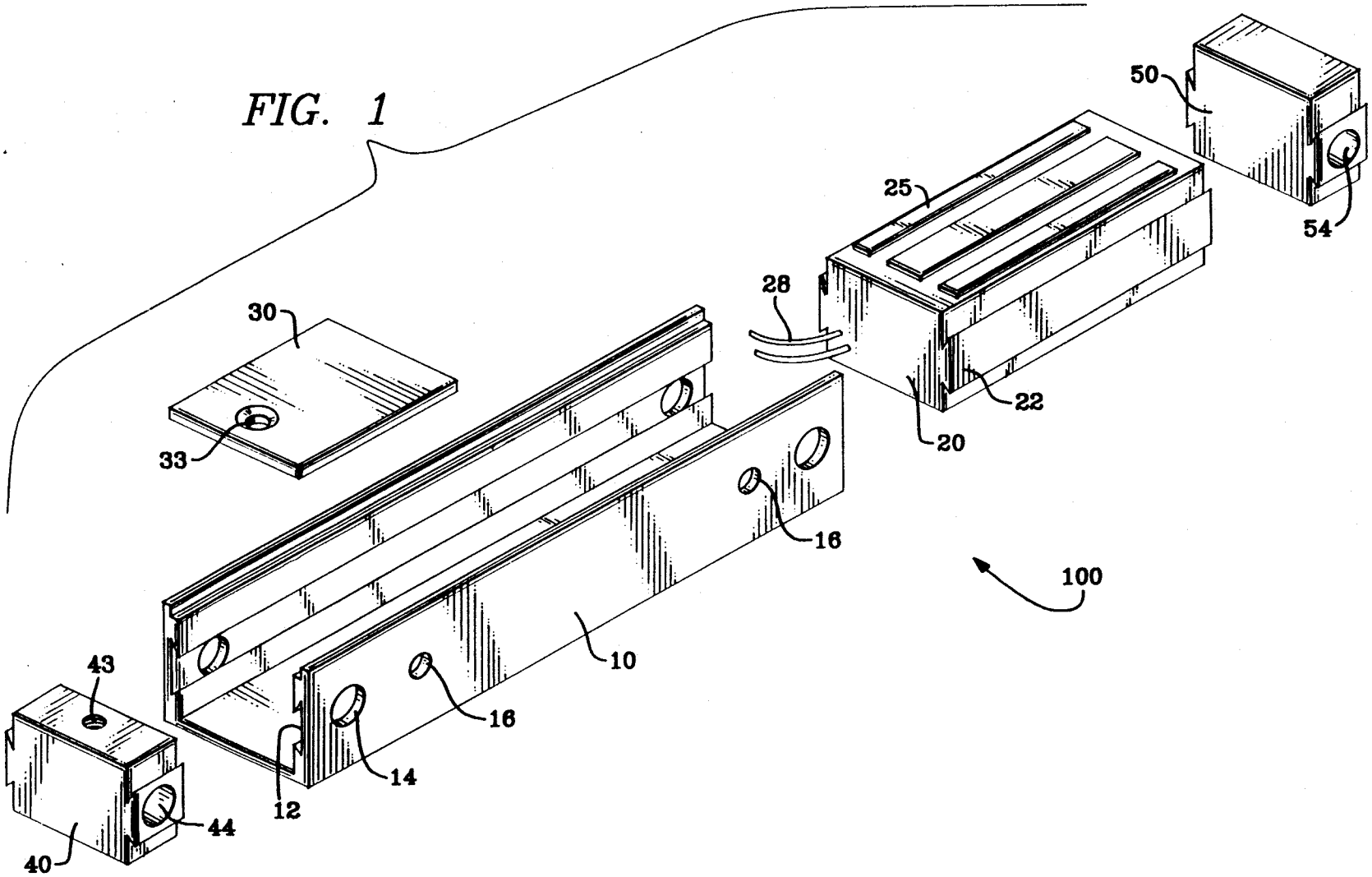
FIG. 1 is an exploded isometric fragmentary view of an embodiment of the electromagnet housing assembly of the present invention.
Figure 2:
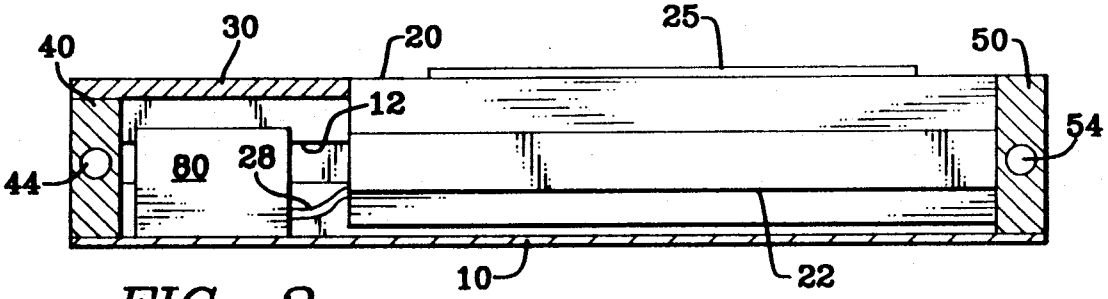
FIG. 2 is a longitudinal partially sectional elevation view showing one handing configuration of the electromagnet assembly.

Referring to FIGS. 1 and 2, the novel features of the present invention can be understood. Electromagnet housing assembly 100 is made up of channel shaped housing member 10, end cap 40, end cap 50, magnet 20, and cover 30.

Channel-shaped housing member 10 is provided with mounting bolt holes 14, two electrical connection access holes 16, and longitudinal dovetail recesses 12. The dovetails 12 are shown here in a recessed configuration, but they could as well be shown in a protrusion configuration. End cap 40 has a threaded hole 43 in which an attachment screw is inserted through hole 33 of cover 30 to secure the cover on end cap 40. Both end caps 40 and 50 have through-drilled mounting holes 44 and 54, respectively, and dovetails 42 and 52 When assembled in housing member 10, these mounting holes align with mounting bolt holes 14. Magnet 20 is seen to be made up of lamination stack 25 encapsulated in a suitable insulating potting compound or thermosetting polymer. Electrical magnet wires protrude from the end face of magnet 20, and lateral dovetails 22 are provided on two lateral sides of magnet 20 to provide an interlocking mechanism to intermesh with dovetail recesses 12 of the housing 10. In this embodiment dovetails 22 are shown as protrusions on magnet 20, while dovetails 12 on housing 10 are shown as recesses. When assembled, the electromagnet housing assembly 100 starts with channel-shaped housing member 10 into which magnet 20 is slid longitudinally with the dovetail protrusions 22 on the magnet and dovetail recesses 12 on housing member 10 intermeshed. End caps 40 and 50 are installed with their dovetails 42 and 52 also intermeshed with dovetail recesses 12 of housing member 10. Magnet 20 is abutted to end cap 50 and cover 30 is attached to end cap 40 using a fastener through hole 33 and threaded into hole 43 of end cap 40.

Figure 3:
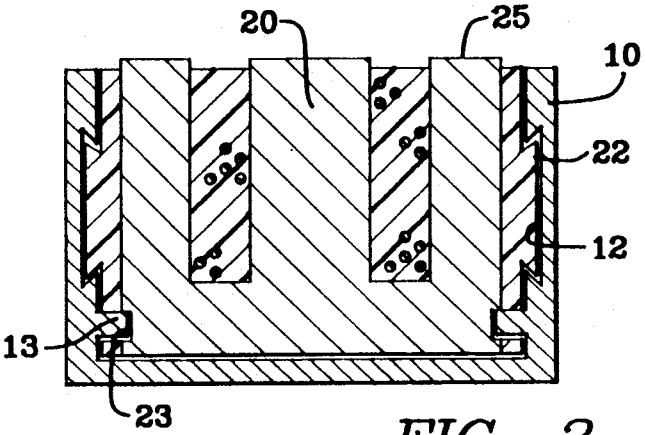
FIG. 3 is a transverse sectional view of the electromagnet housing assembly illustrating a possible interlocking provision.

FIG. 2 shows a partially sectional view of the assembly just described. Here, channel-shaped housing member 10, end caps 40 and 50, magnet 20, and cover 30 are shown assembled with magnet 20 in the right handed position. Reversal of handing configuration or conversion to the left handed configuration requires only an interchange of end caps 40 and 50 and reversal of magnet 20. Lamination stack 25 is shown as protruding slightly from the body of magnet 20, but may, as well, be flush with the surface. Mounting holes 44 and 54, electronic control circuitry 80, and electrical magnet wires 28 are shown to illustrate the assembled relationship between the components FIG. 3 shows a transverse cross sectional view of the assembly mounted on a stationary structural member 110 to illustrate the interlocking provisions of the magnet 20 and channel-shaped housing member 10. A dovetailed housing recess 12 and a card like housing protrusion 13 are shown on each side of channel-shaped housing member 10. Magnet assembly 20 is shown with complementary protrusions and recesses 22 and 23, respectively. The intermeshed protrusion 13 recess 23 couple shown here is effective for retaining magnet assembly 20 within housing member 10; however the dovetail protrusion 22 and dovetail recess 12 provide the additional advantage of increasing the lateral gripping force of channel-shaped housing member 10 on magnet 20 in response to any force tending to pull magnet 20 upward out of channel-shaped housing member 10. This is due to the intermeshed tapers on the protrusion and recess mating surfaces.

Figure 5:
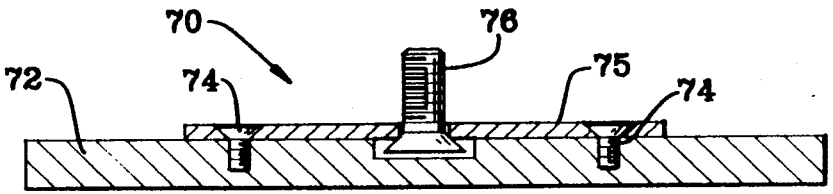
FIG. 5 is a longitudinal cross section of an embodiment of the armature of the present invention.
Figure 4:
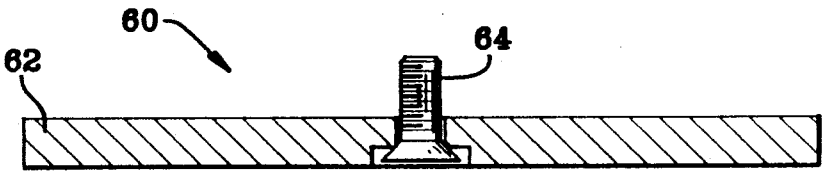
FIG. 4 (PRIOR ART)
FIG. 4 is a longitudinal cross section of an armature of the prior art.

FIGS. 4 and 5 show an armature assembly 60 of the prior art and 70 of the present invention. Armature contact plate 62 is attached to a second structural member, preferably a door or other movable object using mounting bolt 64. This mounting scheme concentrates pulling forces at mounting bolt 64 so that it imposes a bending tendency on plate 62. In order to mitigate this force concentration effect, armature assembly 70 has contact plate 72 attached to a backing plate 75 using backing plate screws 74. Screws 74 are attached to contact plate 72 at widely separated locations. Mounting bolt 76 is centrally located on backing plate 75 for retaining the armature assembly 70 on its structural member. By this arrangement, pulling forces are concentrated at the center of backing plate 75, but these forces are distributed from the backing plate 75 to the contact plate 72 at only half the magnitude of the prior art arrangement. This effectively reduces the peak separating force to half the level it would otherwise attain. It further reduces the tendency of contact plate 72 to bend in response to the force, and thereby permits this armature assembly 70 to tolerate a higher total separating force without failure of the locking function.

The present invention, thus, provides the advantages of simplified assembly of the electromagnet housing assembly as a result of incorporation of the intermeshing longitudinal protrusions and recesses on the lateral surfaces of magnet 20 and channel-shaped housing member 10. The interlocking nature of these protrusions and recesses eliminates the need for several threaded fasteners in the assembly and thereby simplifies assembly. Moreover, attempts to separate the magnet from the housing, in cases where the dovetail intermeshed coupling is provided, cause an increase in the lateral clamping force of the housing against the magnet. Also, by keeping electronic control circuitry separate from the lamination stack and magnet wire coil assembly, the cost of rejects during manufacture is significantly reduced. Coupled with this improvement in the electromagnet housing assembly, the load spreading provision of the armature assembly of the present invention provides significantly improved locking strength and reliability as well as simplified manufacture, assembly, and installation.

What is claimed is:

1. An electromagnetic lock assembly comprising:

a housing made up of an elongate channel-shaped member having one or more longitudinal protrusions and/or recesses;

an electromagnet contained within said housing and having longitudinal recesses and/or protrusions which intermesh with those of the housing to prevent all but longitudinal movement by the electromagnet;

means for mounting said housing on a structural member;

armature means for coacting with said electromagnet to secure contact with said structural member; and means for selectively magnetizing and demagnetizing said electromagnet to, thereby, secure and release said armature with respect to said electromagnet.

2. The lock assembly of claim 1, wherein the housing further comprises first and second end caps having one or more longitudinal recesses and/or protrusions which intermesh with mating protrusions and/or recesses, respectively, on said elongate channel-shaped member, both end caps being fastened to said channel-shaped member such that they are prevented from any movement with respect to said housing, and at least the first of said end caps being equipped with a longitudinally extending member which protects electronic circuitry within said housing and which clamps the electromagnet against said second end cap to prevent longitudinal movement of said electromagnet.

3. The lock assembly of claim 1, wherein the housing containing the electromagnet is mounted on a stationary structure.

4. The lock assembly of claim 1, wherein the housing containing the electromagnet is mounted on a movable structure.

5. In an electromagnetic lock of the type having an elongate housing having one open side and containing an electromagnet, said housing being mounted on a structure; an armature means for coacting with the electromagnet; and control circuitry connected with said electromagnet for selectively magnetizing and demagnetizing the electromagnet, the improvement comprising:

one or more longitudinal protrusions and/or recesses in the walls of said housing;

one or more longitudinal recesses and/or protrusions in the walls of said electromagnet which intermesh with the protrusions and/or recesses, respectively, of said housing, such that the electromagnet is longitudinally movable but otherwise fixed with respect to said housing; and first and second end caps fastened to the ends of said housing, at least the first of said end caps being equipped with a longitudinal member which protects the control circuitry and which clamps said electromagnet against said second end cap.

* * * * *